US009550591B2

(12) United States Patent
Jöhren et al.

(10) Patent No.: US 9,550,591 B2
(45) Date of Patent: Jan. 24, 2017

(54) METHOD FOR PRODUCING MULTIPACKS OF CONTAINERS BY ADHESIVELY BONDING THE CONTAINERS TO ONE ANOTHER

(71) Applicant: KHS GmbH, Dortmund (DE)

(72) Inventors: Thomas Jöhren, Kleve (DE); Jörg Koppers, Uedem (DE); Thomas Nitsch, Kleve (DE); Volker Zahn, Volkmarsen (DE); Wilko Flügge, Cramme (DE); Tobias Böddeker, Wolfenbüttel (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 14/893,678

(22) PCT Filed: Apr. 9, 2014

(86) PCT No.: PCT/EP2014/057212

§ 371 (c)(1),
(2) Date: Nov. 24, 2015

(87) PCT Pub. No.: WO2014/191132

PCT Pub. Date: Dec. 4, 2014

(65) Prior Publication Data

US 2016/0114919 A1 Apr. 28, 2016

(30) Foreign Application Priority Data

May 27, 2013 (DE) ..... 10 2013 105 428

(51) Int. Cl.

| | |
|---|---|
| ***B65B 27/04*** | (2006.01) |
| ***B65B 17/02*** | (2006.01) |
| ***B65B 21/00*** | (2006.01) |

(52) U.S. Cl.

CPC ..... *B65B 17/02* (2013.01); *B65B 21/00* (2013.01); *B65B 27/04* (2013.01); *Y10T 156/1744* (2015.01)

(58) Field of Classification Search

CPC ..... B65B 17/02; B65B 17/025; B65B 27/04; B65B 21/00; B65B 21/0205; Y10T 156/10; Y10T 156/1317; Y10T 156/1744; Y10T 156/1749; Y10T 156/1751; Y10T 156/1768; Y10T 156/1771

See application file for complete search history.

(56) References Cited

U.S. PATENT DOCUMENTS

| | | | | |
|---|---|---|---|---|
| 3,388,791 A | | 6/1968 | Walsh | |
| 3,759,378 A | * | 9/1973 | Werth | B65D 21/0205 206/192 |

FOREIGN PATENT DOCUMENTS

| | | |
|---|---|---|
| DE | 26 45 495 | 4/1978 |
| DE | 692 18 238 | 10/1997 |
| DE | 197 48 978 | 5/1999 |
| DE | 101 16 022 | 10/2001 |
| DE | 103 93 236 | 12/2005 |

(Continued)

*Primary Examiner* — Carson Gross

(74) *Attorney, Agent, or Firm* — Occhiuti & Rohlicek LLP

(57) ABSTRACT

A method for producing multipacks of containers includes placing adhesive spots on surfaces of the containers. At least two kinds of adhesives are used, both of which plastic melt adhesives that melt as a result of exposure to heat and that develop cohesion after cooling. After placing the adhesive spots, the containers are connected to each other using the adhesive spots so as to form a multipack.

22 Claims, 3 Drawing Sheets

(56) References Cited

FOREIGN PATENT DOCUMENTS

| | | | | |
|---|---|---|---|---|
| DE | 102009025824 | * | 11/2010 | ..... B65B 17/02 |
| DE | 10 2011 106 759 | | 9/2012 | |
| DE | 10 2011 107 264 | | 1/2013 | |
| DE | 10 2011 10726 | | 1/2013 | |

* cited by examiner

METHOD FOR PRODUCING MULTIPACKS OF CONTAINERS BY ADHESIVELY BONDING THE CONTAINERS TO ONE ANOTHER

RELATED APPLICATIONS

This application is the national stage, under 35 USC 371, of international application PCT/EP2014/057212, filed on Apr. 9, 2014, which claims the benefit of the May 27, 2013 priority date of German application DE 102013105428.5, the content of which is herein incorporated by reference.

FIELD OF INVENTION

The invention relates to packaging, and in particular, to producing multipacks of containers.

BACKGROUND

A multipack is a group of containers that have been packaged together. A common way to form a multipack is by forming a container group and shrink-wrapping it. This results in additional method steps. In addition, it requires consuming a special film and expending considerable energy. To make matters worse, sometimes the film obscures the view of important features such as labels or imprints on the containers. As a result, the visual appearance of such multipacks leaves much to be desired.

A known way to overcome these disadvantages is by gluing the containers together with adhesive. A variety of adhesives can be used. These include hot-melt adhesives. Such adhesives can be melted on by applying heat. After cooling, the adhesive binds the containers.

The removal of individual containers from the multipack is not always problem-free however. Ideally, the individual containers are tightly bonded to one another. This implies a need for a high adhesive strength. But high adhesive strength makes it difficult to remove individual bottles from the multipack. In addition to this, a wide temperature application range is required for the adhesive used. Additionally, it is desirable to be able to peel the adhesive off the surface of the container.

SUMMARY

An object of the invention is that of producing multipacks of containers in a simple and economical way while still providing a mechanically stable multipack.

To achieve this, the method described herein uses at least two different adhesivities for production of multipacks. This can be done by using two or more different adhesives or bonding agents.

A multipack can be formed of only two containers joined by an adhesive spot. In one aspect, the adhesive spot has zones of different adhesivity. This is typically implemented by making the zones out of different adhesives. The overall adhesive strength of the adhesive spot is thus the integral of a spatially varying adhesivity over the extent of the adhesive spot.

Most multipacks have 2n containers, where n>1. In these embodiments, there are at least three adhesive spots. In some embodiments, individual adhesive spots have two or more zones of different adhesivity, typically implemented by using different adhesive materials. Alternatively, different adhesive spots can be made to differ in ways that affect their adhesivity. This might include having different thicknesses, spatial extents, and expansions, or having adhesive spots that undergo different preliminary treatments, or any combinations thereof.

In some embodiments, adhesive spots in an inner region of the multipack exhibit a greater expansion than at those at its periphery. As a result, the containers located in the interior of the multipacks are connected to each other more securely than containers at the periphery of the multipack. As a result, containers at the periphery of the multipack can be released more easily than those in the interior.

Some embodiments rely on the fact that an adhesive spot that that has expanded substantially often has increased adhesive strength. As used herein, adhesive strength is the integral of adhesivity as measured in units of force per unit area, such as $N/mm^2$. The total adhesive strength is thus the integral of adhesivity over the area of the adhesive spot. This means that the one can control the adhesive strength of an adhesive spot by controlling its area.

In some embodiments, the adhesive spots have different thicknesses. This feature is useful because most multipacks are formed by assembling essentially cylindrical containers. Thus, different thicknesses are required to achieve contact between different surfaces. Additionally, the greater the layer thickness as applied, the more the spot will spread when the containers are brought into contact. Since adhesive strength depends on surface area of the spot, different spots will again have different adhesive strengths depending on the thickness of the applied adhesive.

In addition to this, the adhesive spots can have different compositions. For example, an adhesive spot can have one adhesive or more than one adhesive. This makes it possible to control the overall adhesive strength of the adhesive spot and to also have adhesive spots of different adhesive strengths at different places in the multipack.

Other ways to control adhesive strength on a spot-by-spot basis include applying different pre-treatments to the different adhesive spots. For example, in some spots, the adhesive is applied over a base layer or coating such that the adhesive and base layer cooperate to attain an adhesivity that differs from that of an adhesive by itself.

Alternatively, pre-treatment can be carried out to control adhesivity. One way to do this is to cross-link the adhesive, for example by exposing it to ultraviolet radiation. This will polymerize the adhesive and result in increased cohesion and/or adhesive strength.

In some embodiments, the adhesive spots are designed and placed such that containers near the center of the multipack or within its interior are joined with relatively high adhesive strengths, and containers near the periphery are joined with lower adhesive strengths. This results in containers at the periphery being easier to remove from the multipack than those in the interior.

In another aspect of the invention, the differently formed adhesives have different chemical and/or physical properties.

As noted above, it is useful to have variable adhesive strengths and/or the peel strengths. To ensure that adhesion between containers is adequate, it is useful to adhesivities in the range from approximately 0.1 $N/mm^2$ to 1 $N/mm^2$.

The "peel strength" relates to the ability of the adhesive to be able to adhere to the container. Peel strength is measured by applying a constant force to remove the adhesive and seeing how long it takes to do so. A short time indicates a low peel strength, and vice-versa.

In most cases, the arrangement of adhesive spots is such that adhesive spots within the interior of the multipack tend to have greater adhesive strength and peel strength than those at the periphery of the pack. This promotes mechanical support of the inner cohesion of the multipack while concurrently permitting easy detachment of the containers at the periphery.

An adhesive spot can be made out of two different adhesives. In most cases, the two different adhesives will occupy different zones of the adhesive spot. In this situation, the zones may in principle delimit one another so that they are contiguous with each other.

As an alternative, or in addition, it is also possible for the zones to be spaced apart from one another, and also to be arranged relative to each other according to some preselected configuration. The zones thus take a form similar to the dots on a playing die. The dots that mark the individual zones in such cases can be formed by the different adhesives.

In some embodiments, the adhesive spot has a center zone made of an adhesive with high adhesivity. Then, zones around this center zone are made of adhesive with lower adhesivity. These zones are distributed around the center zone in a circular or star-shaped fashion. In this way, the adhesives can be combined in any desired manner in order to define a particular adhesive spot.

It is also advantageous in some cases for adhesive spots at different vertical locations on a container to have different adhesivities. For example, in some embodiments the adhesive spots on the bellies of the containers have higher adhesive strength than those on the base. This makes it easier for consumers to detach the container at the base and then to use the container as a lever to help detach the stronger adhesive at the belly.

In most cases work is carried out with spots of bonding or adhesive agents which in each case are realized in pairs; i.e. they are located both on the belly as well as on the base of the container concerned.

In another variant, adhesive spots inside the multipack are applied in different circumferential positions on the container. This affects the ease with which a container can be peeled off the multipack. A similar result can be achieved by providing adhesive spots along the container axis and varying the adhesive strength of those adhesive spots.

Adhesive parameters other than adhesive strength and/or peel strength can also be varied. For example, one can use heat-resistant adhesive or cold-resistant adhesive. The heat-resistant adhesive is typically well-suited for applications in the temperature range from some 10° C. to 45° C., whereas cold-resistant adhesive is typically well-suited for a temperature range of, for example, −6° C. to 20° C. In this way, the production of the multipack can be carried out in its entirety and worldwide in the same manner and with recourse to concordant adhesives. Essentially, depending on the outside temperature or ambient temperature respectively, either the heat-resistant adhesive or the cold-resistant adhesive develops its desired effect.

A suitable type of adhesive is a plastic melt adhesives. Such melt adhesives melt when heated and then develop cohesion and inner strength upon cooling. Examples of melt adhesives are those that consist basically of one or more polymers, supplemented by additives. Suitable base polymers include ethylene-vinyl-acetate (EVA), polyolefins (APAO), polyamides (PA), rubber adhesives (SIS/SBS) and others. In addition to this, additives such as waxes or resins, such as tackifiers, can be added. Such waxes serve as diluting agents and reduce the viscosity and adhesion. Tackifiers reduce the cohesion and at the same time increase the tackiness, and in consequence the attainable adhesive strength.

The inventive method thus provides a way to produce multipacks that satisfies requirements that are inherently in conflict. In this way, the multipack is in the first instance produced as filmless, and it is therefore possible in practice, as heretofore, to develop the steps of film application, film shrinkage, and also the provision of the film. In addition to this, the multipacks do not have a film. Therefore, it is easier for the consumer to see the labels.

Additionally, with the containers connected with adhesive spots as described herein, the mechanical stability of the multipack becomes comparable to that of a multipack that has been wrapped with film. As a result, there is no need to make accommodations when handling and transporting such a multipack. Additionally, it is possible to remove containers from the multipack with ease.

In some embodiments, the adhesive strength of adhesive spots varies with location on a single container. For example, it is possible to have a highly adhesive spot at the container's belly and a less adhesive spot at the container's base. In that case it will be easier to detach the container from the top. Or, the configuration can be reversed to that the more adhesive spot is at the base and the less adhesive spot is at the belly.

The invention opens up the possibility of adapting the adhesive and the adhesive spot so that one has different adhesive strengths at different locations within the multipack. This flexibility makes it possible to more easily tune the mechanical requirements to accommodate multipacks of different sizes and shapes while taking into account sizes and weights of sizes and weights of the containers.

In this connection, the individual containers are, for example, initially not yet fully formed in the channels, and are formed into temporary container groups. Additionally, the separation of the containers in each channel takes place in such a way that, in the transport direction, the containers in each channel exhibit a predetermined spacing interval from one another. The respective containers are next aligned by controlled rotation about the container axis. To do this, the respective container in each case is provided with an alignment feature, in order then to be able to produce the spot of applied bonding or adhesive agent after the separation in the channel. Finally, the aligned containers are connected to one another to form in each case compacted and shaped container groups, in that, for example, a container provided with the relevant spot of applied bonding or adhesive agent is connected to a container without such a spot. The essential advantages are to be seen herein.

In one aspect, the invention features a method of producing multipacks of containers by using different adhesivities to interconnect containers. This can include selecting first and second plastic melt adhesives that melt as a result of exposure to heat and that develop cohesion after cooling. Adhesive spots are then placed on surfaces of containers. The adhesive spots have at least two different adhesivities. The containers are then connected to each other using the adhesive spots, thereby forming the multipack.

Practices of the invention include those in which the adhesives have different physical properties and those in which they have different chemical properties.

Practices of the invention also include those in which adhesive spots differ by having different thicknesses, those in which they differ by having different compositions, those in which they differ by having different spatial extents, and those in which they differ by having undergone different pre-treatment procedures.

In some practices, each adhesive spot is made of two different adhesives. Among these practices are those in which the adhesives define different zones of the adhesive spot. These zones can adjoin one another. Alternatively, they can define a zonal archipelago in which the zones are separated from each other. Among these are adhesive spots in which the zones form a pre-selected configuration.

In other practices, there are two kinds of adhesive spots, one made with a first adhesive and the other made with a second adhesive.

Other practices include placing die spots of adhesive in different vertical and/or horizontal positions on a container, placing die spots of adhesive in different circumferential positions on a container, placing die spots of adhesive in different radial positions on a container, and placing die spots of adhesive in different axial positions on a container.

Some practices include the use of adhesives having different adhesivities, and/or adhesives that have undergone differing preliminary treatments.

In yet other practices, the multipack is a filmless multipack.

Also among the practices are those in which the containers are arranged according to rows and columns in the multipack. In these practices, placing adhesive spots on surfaces of containers includes placing them in a manner that causes an adhesive strength that connects rows to each other to be different from an adhesive strength that connects columns to each other.

Some practices include placing adhesive spots in a manner such that the adhesive strength between containers varies as a function of location of said containers within said multipack. Among these are those practices in which a first container is at a periphery of said multipack, a second container is at an interior of said multipack, and adhesive spots are so placed as to cause the first container to bond to an adjacent container with a first adhesive strength, and to cause the second container to bond to a neighboring container with a second adhesive strength that is greater than the first adhesive strength.

BRIEF DESCRIPTION OF THE DRAWINGS

These and other features and advantages of the invention will be apparent from inspection of the following detailed description and the accompanying figures, in which.

DETAILED DESCRIPTION

Figure 1:
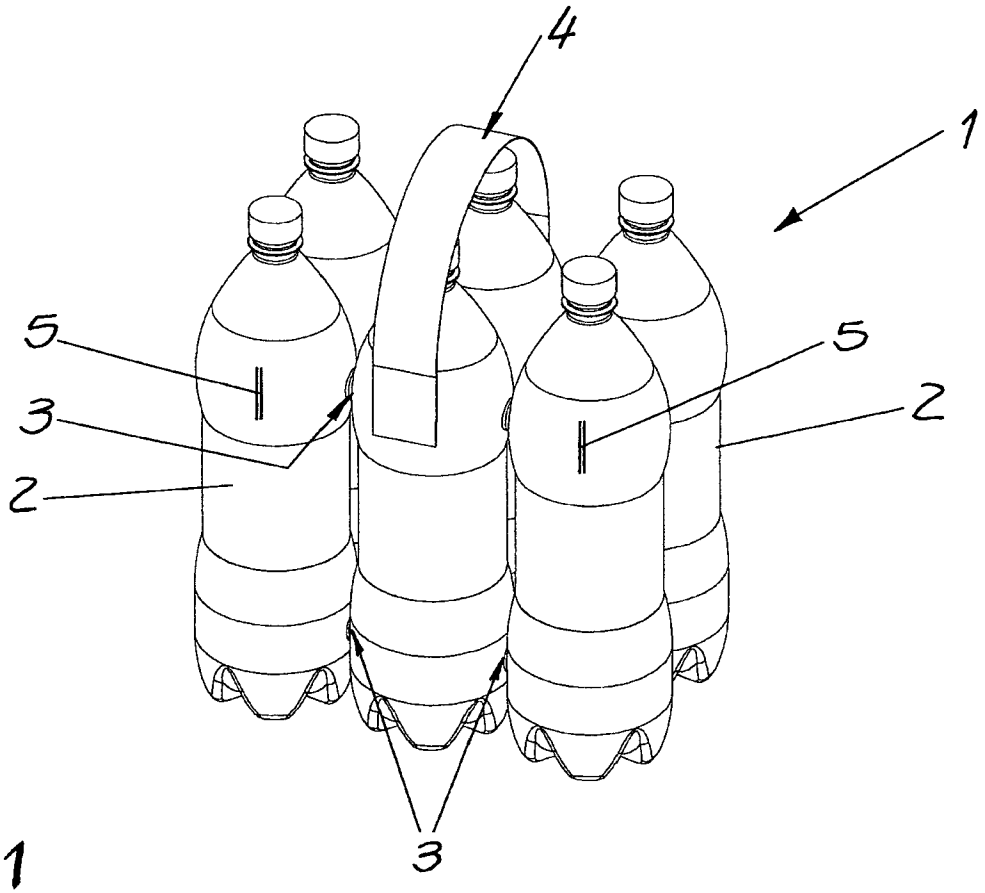
FIG. 1 shows a multipack of containers produced in accordance with the method according to the invention.
Figure 2:
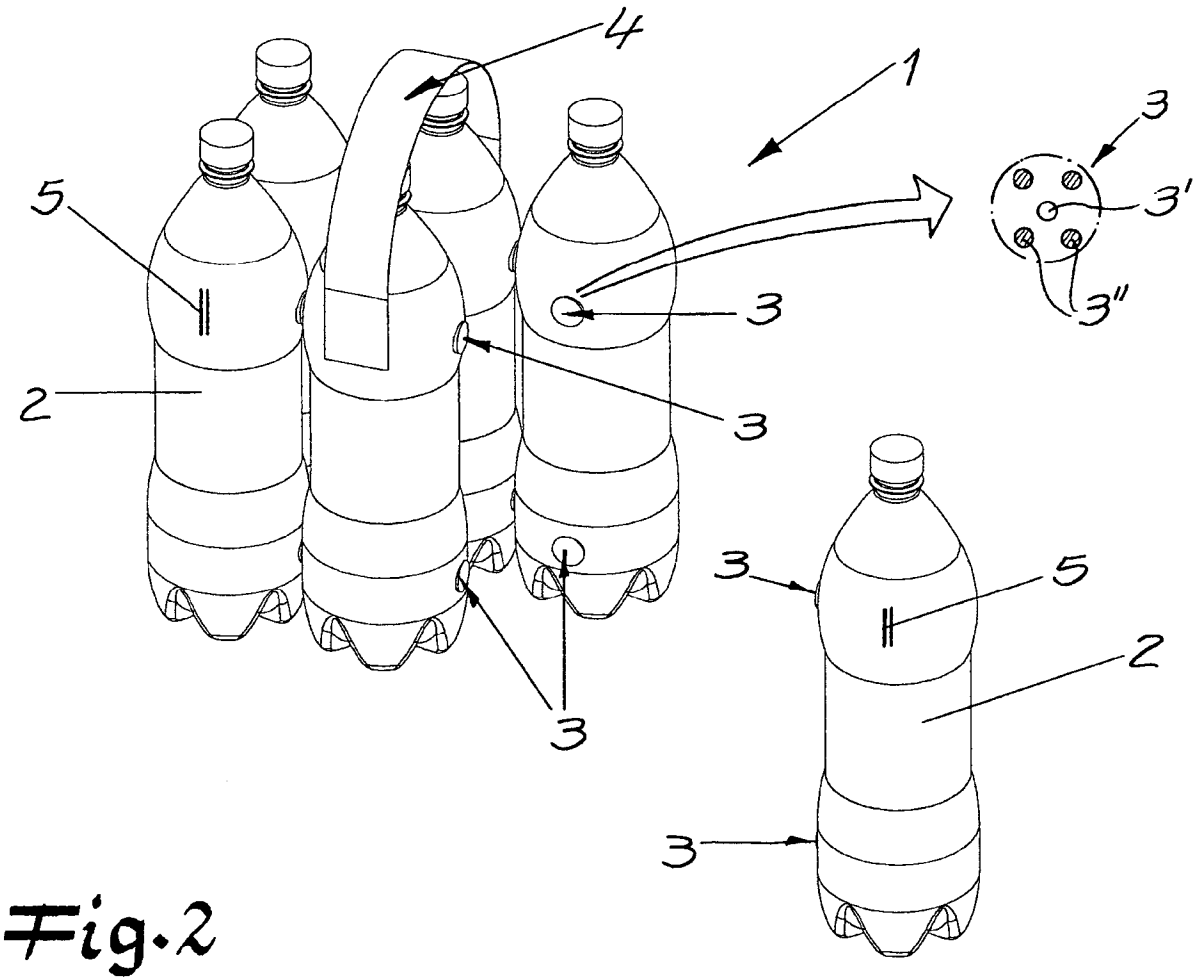
FIG. 2 shows the multipack according to FIG. 1, with a container detached and a close-up view of a multi-zonal adhesive spot.

FIGS. 1 and 2 show a multipack 1 having containers 2 joined to each other by adhesive spots 3. The resulting multipack 1 avoids the use of shrink wrap or film.

The particular multipack 1 shown in FIG. 1 is a six-piece multipack because it has six containers 2. However, other numbers of containers 2 can be formed into a multipack 1.

In some multipacks 1, the individual containers 2 are PET bottles. However, other types of containers can be used.

The adhesive spots 3 are spots of bonding or adhesive agents that connect the individual containers 2 to one another. As used herein, "adhesive" refers to any bonding or adhesive agent." An adhesive spot 3 is made of one or more of these bonding or adhesive agents.

For the customer's convenience, a multipack 1 has an optional carrying handle or carrying loop 4 having first and second ends that connect to opposed first and second containers 2 as shown in FIGS. 1 and 2. In some embodiments, the carrying loop 4 is adhesively bonded to the containers 2.

Each container 2 also has an alignment feature 5. These alignment features 5 are used by a container-processing machine as a basis for rotating individual containers 2 about their container axes so as to bring the adhesive spot 3 into the desired position.

Figure 3B:
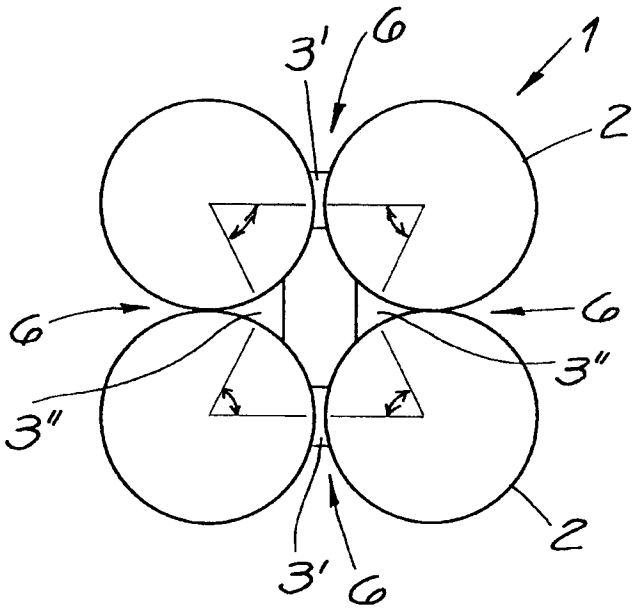
FIGS. 3A and 3B show two principle methods for the application of the spot of applied bonding or adhesive agent during the realization of an alternative multipack.
Figure 3A:
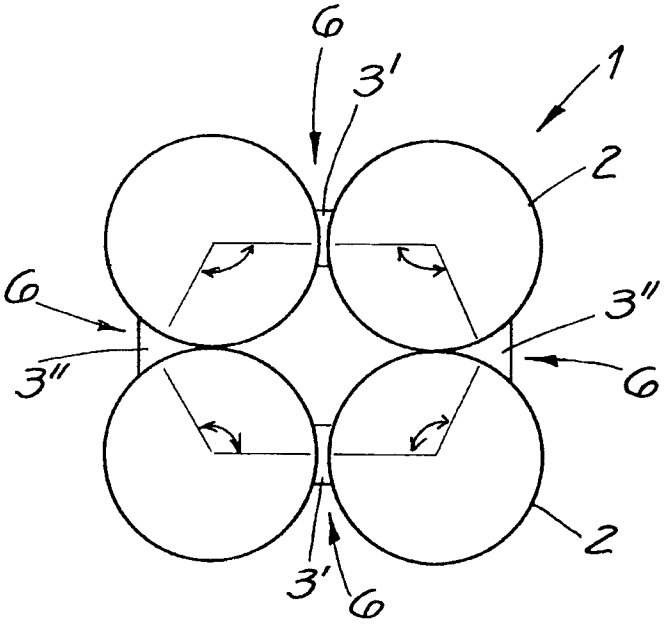

In FIG. 2, one container 2 has been removed from the multipack 1 to reveal the locations of the adhesive spots 3. It can be seen that adhesive spots are placed so that every container has one or more adhesive spots 3 that face its adjacent containers. The adhesive spots 3 can be found on the belly, on the head, or near the base of a container 2. It is of particular importance that each point of contact between two containers 2 in a multipack 1 have an adhesive spot thereon, as shown in FIGS. 3A and 3B.

FIGS. 1 and 2 show a paired arrangement in which a container 2 has a pair of adhesive spots 3 at its head or, respectively, at its belly and near its base. In some cases, an adjacent container 2 does not have any adhesive spot 3 at all. In other cases, the two adhesive spots are on different containers 2. For example one container 2 has the adhesive spot 3 on the head side and an adjacent container 2 has an adhesive spot 3 on its base.

In some embodiments, it is useful for the adhesive spot 3 to made from least two adhesives. The enlarged portion of FIG. 2 shows an adhesive spot 3 formed by first and second adhesives that define first and second zones 3', 3" of the adhesive spot 3. The different adhesives have different physical or chemical properties.

In the embodiment show, the first and second zones 3', 3" of the adhesive spot 3 are spaced apart to form an archipelago of zones 3', 3" arranged in a preselected configuration. However, in other embodiments, the zones 3' 3" are contiguous, and thus do not form adhesive islands within the spot 3.

In the illustrated embodiment, the zones 3', 3" are arranged like the spots in a standard five-spot die from a pair of dice used in a typical casino for such games as craps. The arrangement features a centered first zone 3' and four second zones 3" that define vertices of a square centered about the first zone 3'.

In the configuration shown, the first zone 3' is made of a first adhesive having a high adhesive strength. In contrast, the second zones 3" are made of a second adhesive having an adhesive strength that is lower than that of the first adhesive. This arrangement enables a container 2 to be easily detached from the multipack 1, as illustrated in FIG. 2.

In the embodiments of FIGS. 1 and 2, the adhesive spots 3 and any zones 3', 3" thereof are arranged in horizontal planes that are coplanar. In this situation there is the further possibility of applying the individual adhesive spots 3, 3', 3" inside the multipack 1 in different positions on the container 2, as indicated in FIGS. 3A and 3B. These can be placed in the same horizontal plane, in different vertical positions, or in different positions in relation to a longitudinal axis of the container 2.

Each container 2 has a container axis that defines a cylindrical coordinate system for that container 2. Adhesive spots 3 can be applied anywhere on the surface of that container 2 at any axial coordinate and at any circumferential coordinate defined by the cylindrical coordinate system.

FIGS. 3A and 3B show containers 2 arranged in rows and columns in a multipack 1. Although only four containers are shown, it will be understood that a multipack is in effect a container lattice for which the arrangement shown in FIGS. 3A and 3B forms a primitive cell that is tiled to form the lattice. Thus, the description of FIGS. 3A and 3B is applicable to any subset of four containers in a larger multipack 1.

The multipack 1 consists of a first container, a second container, a third container, and a fourth container arranged to form vertices of a square. The first and second containers define a top row, the third and fourth containers define a bottom row, the first and third container define a left column, and the second and fourth containers define a right column. A first set of adhesive spots 3' joins the left and right columns of containers 2 and a second set of adhesive spots 3" joins the top and bottom rows of containers 2.

A convenient way to refer to the different circumferential coordinates of the adhesive spots 3', 3" in FIGS. 3A and 3B is by reference to different positions on a clock face.

In FIG. 3A, each container in the left column has an adhesive spot 3' at the three o'clock position, whereas each container in the right column has an adhesive spot 3' at the nine o'clock position. These spots 3' hold the two columns together.

Additional spots 3" hold the top row to the bottom row. In particular, the second container, which is in the top row and right column, has an adhesive spot 3" at the five o'clock position while the fourth container, which is in the bottom row and the right column, has an adhesive spot 3" at the one o'clock position. Meanwhile, the first container, which is in the top row and left column, has an adhesive spot 3" at the seven o'clock position and the third container, which is in the bottom row and left column, has an adhesive spot 3" in the eleven o'clock position.

An alternative way to describe the circumferential coordinates of the adhesive spots 3', 3" is by identifying an inter-spot angle formed by a first line that extends from the first adhesive spot 3' to the container axis, and a second line that extends from the second spot 3" to the container axis. In the embodiment shown in FIG. 3A, these inter-spot angles are all obtuse angles. In contrast, in the embodiment shown in FIG. 3B, the second adhesive spots 3" have been interchanged so that the resulting inter-spot angle becomes acute.

In some embodiments, the adhesive strength that connects columns to each other can differ from that connecting rows to each other. This affects the manner in which one would separate containers from the multipack 1. For instance, if the adhesive strength connecting columns to each other is the greater of the two, it will be easier to separate one row at a time from the multipack 1. Conversely, if the adhesive strength connecting rows to each other is the greater of the two, it will be easier to separate one column at a time from the multipack 1.

This difference between adhesive strengths is suggested in FIGS. 3A and 3B by showing adhesive spots 3', 3" that have different thicknesses, with the second adhesive spots 3" being noticeably thicker than the first adhesive spots 3'. Having first and second sets of adhesive spots 3', 3" with different adhesive strengths can be executed in different ways, for example by using different adhesive materials or different configurations of adhesive materials within a spot, or by pre-treatment of the adhesive material.

Having described the invention, and a preferred embodiment thereof, what we claim as new, and secured by Letters Patent is:

1. A method for packaging containers, said method comprising producing multipacks of containers, wherein producing multipacks comprises selecting first and second adhesives that are plastic melt adhesives that melt as a result of exposure to heat and that develop cohesion after cooling, placing adhesive spots on surfaces of containers, wherein said adhesive spots comprise at least said first and second adhesives, and connecting said containers to each other using said adhesive spots, thereby forming said multipack, wherein a first container is at a periphery of said multipack and a second container is at an interior of said multipack, wherein placing adhesive spots on surfaces of containers comprises placing adhesive spots to cause said first container to bond to an adjacent container with a first adhesive strength, and causing said second container to bond to a neighboring container with a second adhesive strength, wherein said first adhesive strength is less than said second adhesive strength.

2. The method of claim 1, wherein said first and second adhesives have different physical properties.

3. The method of claim 1, wherein said first and second adhesives have different chemical properties.

4. The method of claim 1, wherein said adhesive spots have different thicknesses.

5. The method of claim 1, wherein said adhesive spots have different compositions.

6. The method of claim 1, wherein said adhesive spots have different spatial extents.

7. The method of any one of claim 1, wherein each adhesive spot comprises said first and second adhesives.

8. The method of claim 1, wherein said first and second adhesives define different zones of an adhesive spot selected from said adhesive spots.

9. The method of claim 8, wherein said different zones adjoin one another.

10. The method of claim 8, wherein said different zones form an archipelago of zones.

11. The method of claim 8, wherein said different zones form a preselected configuration.

12. The method of claim 1, wherein said adhesive spots comprise a first subset and a second subset, wherein adhesive spots of said first subset are made only with said first adhesive and adhesive spots of said second subset are made only with said second adhesive.

13. The method of claim 1, wherein placing adhesive spots on surfaces of containers comprises placing die spots of adhesive in different vertical positions on a container.

14. The method of claim 1, wherein placing adhesive spots on surfaces of containers comprises placing die spots of adhesive in different circumferential positions on a container.

15. The method of claim 1, wherein placing adhesive spots on surfaces of containers comprises placing die spots of adhesive in different radial positions on a container.

16. The method of claim 1, wherein placing adhesive spots on surfaces of containers comprises placing die spots of adhesive in different axial positions on a container.

17. The method of claim 1, wherein the said first and second adhesives have different adhesive strengths.

18. The method of claim 1, wherein the said first and second adhesives have undergone differing preliminary treatments.

19. The method of claim 1, wherein said multipack is a filmless multipack.

20. The method of claim 1, wherein placing adhesive spots on surfaces of containers comprises placing said adhesive spots in a manner such that the adhesive strength between containers varies as a function of location of said containers within said multipack.

21. The method of claim 1, wherein placing adhesive spots on surfaces of containers comprises placing die spots of adhesive in different horizontal positions on a container.

22. A method for packaging containers, said method comprising producing multipacks of containers, wherein producing multipacks comprises selecting first and second adhesives that are plastic melt adhesives that melt as a result of exposure to heat and that develop cohesion after cooling, placing adhesive spots on surfaces of containers, wherein said adhesive spots comprise at least said first and second adhesives, and connecting said containers to each other using said adhesive spots, thereby forming said multipack, wherein said containers are arranged according to rows and columns in said multipack, wherein placing adhesive spots on surfaces of containers comprising placing said adhesive spots in a manner that causes an adhesive strength that connects rows to each other to be different from an adhesive strength that connects columns to each another.

* * * * *